US007111415B2

(12) United States Patent
Hockerson

(10) Patent No.: US 7,111,415 B2
(45) Date of Patent: Sep. 26, 2006

(54) ATHLETIC SHOE FRAME

(76) Inventor: Stanley Hockerson, 6718 Mossman Pl., Albuquerque, NM (US) 87110

( * ) Notice: Subject to any disclaimer, the term of this patent is extended or adjusted under 35 U.S.C. 154(b) by 93 days.

(21) Appl. No.: 10/909,972

(22) Filed: Aug. 3, 2004

(65) Prior Publication Data

US 2005/0198863 A1 Sep. 15, 2005

Related U.S. Application Data

(63) Continuation-in-part of application No. 10/714,546, filed on Nov. 14, 2003, now abandoned.

(60) Provisional application No. 60/426,003, filed on Nov. 14, 2002.

(51) Int. Cl.
*A43B 13/12* (2006.01)

(52) U.S. Cl. ..... 36/30 R; 36/102; 36/114; 36/31

(58) Field of Classification Search ..... 36/30 R, 36/25 R, 3 B, 29, 126, 128, 129, 149, 114, 36/44

See application file for complete search history.

(56) References Cited

U.S. PATENT DOCUMENTS

| | | | | |
|---|---|---|---|---|
| 1,852,883 | A * | 4/1932 | Gustaveson | 36/3 R |
| 4,187,620 | A * | 2/1980 | Selner | 36/28 |
| 4,223,455 | A * | 9/1980 | Vermeulen | 36/29 |
| 5,179,791 | A * | 1/1993 | Lain | 36/27 |
| 5,317,822 | A * | 6/1994 | Johnson | 36/101 |
| 5,367,791 | A * | 11/1994 | Gross et al. | 36/31 |
| 6,038,790 | A * | 3/2000 | Pyle et al. | 36/30 R |
| 6,145,221 | A | 11/2000 | Hockerson | 36/126 |
| 6,219,939 | B1 * | 4/2001 | Kita et al. | 36/28 |

* cited by examiner

*Primary Examiner*—Jila M. Mohandesi
(74) *Attorney, Agent, or Firm*—Richard E. Backus

(57) ABSTRACT

A shoe having a stabilizer frame in combination with a midsole to provide stabilizing of the shoe and the user's foot when the shoe is weighted during the gait cycle. The stabilizer frame has a plurality of downwardly convex arch shaped load stabilizer elements which are closely fitted within seats formed in the sides of the midsole. The frame and load stabilizer elements are assembled in sandwich fashion between the midsole and an insole that is mounted with an upper on the shoe.

8 Claims, 5 Drawing Sheets

ATHLETIC SHOE FRAME

CROSS-REFERENCE TO PRIOR APPLICATION

This application now abandoned, is a continuation-in-part of application Ser. No. 10/714,546 filed Nov. 14, 2003, and claims the benefit under 35 USC §119(e) of U.S. provisional application Ser. No. 60/426,003 filed Nov. 14, 2002.

BACKGROUND OF THE INVENTION

1. Field of the Invention

This invention relates to athletic shoes, and more particularly to arrangements for the stabilization of athletic shoes.

2. Description of the Related Art

Conventional athletic shoes such as running or jogging shoes use various arrangements for controlling pronation during the gait cycle. Pronation is an inward roll toward the medial side of a shoe following heel contact with a running surface. This in turn causes the foot shod with the shoe to pronate inwardly. Over-pronation is undesirable and can lead to various foot problems, such as inflammation, swelling and pain in the knee, a condition commonly known as "runners knee". Some runners need a shoe which controls supination, which is an outward roll toward the lateral side of a shoe following heel contact.

Presently in an effort to control pronation, most shoe companies use a dense material on the medial side of the shoe. Another existing shoe design uses a nylon plate sandwiched between the midsole in a wave fashion, but the design does not provide forefoot protection from midsole breakdown. Other shoe designs use plastic strips attached to the medial side of the midsole, as in U.S. Pat. No. 5,279,051 to Whatley.

Despite the various shoes in the prior art that are designed to control pronation, there has not been a suitable solution to the foregoing problems and shortcomings of existing athletic shoes. It would be desirable to provide a shoe design which is more stable for controlling over-pronation and alleviating many of the undesirable consequences from such over-pronation.

OBJECTS OF THE INVENTION

It is a general object of this invention to provide a new and improved stable athletic shoe which has more stability than existing shoe design.

Another object is to provide an athletic shoe of the type described that is more effective in controlling over-pronation.

Another object is to provide an athletic shoe of the type described that provides good stability and is also light in weight.

Another object is to provide an athletic shoe of the type described that provides forefoot protection from midsole breakdown along with enhancing performance.

Another object is to provide an athletic shoe of the type described that allows for an inexpensive method of manufacture and easy tooling.

Other objects and advantages are provision of a cushioned midsole without adding excess weight, spreading cleat pressure without inhibiting sole flexion, and balancing the need for traction and cushion in a sole without adding excess thickness.

DESCRIPTION OF THE PREFERRED EMBODIMENTS

Figure 1:
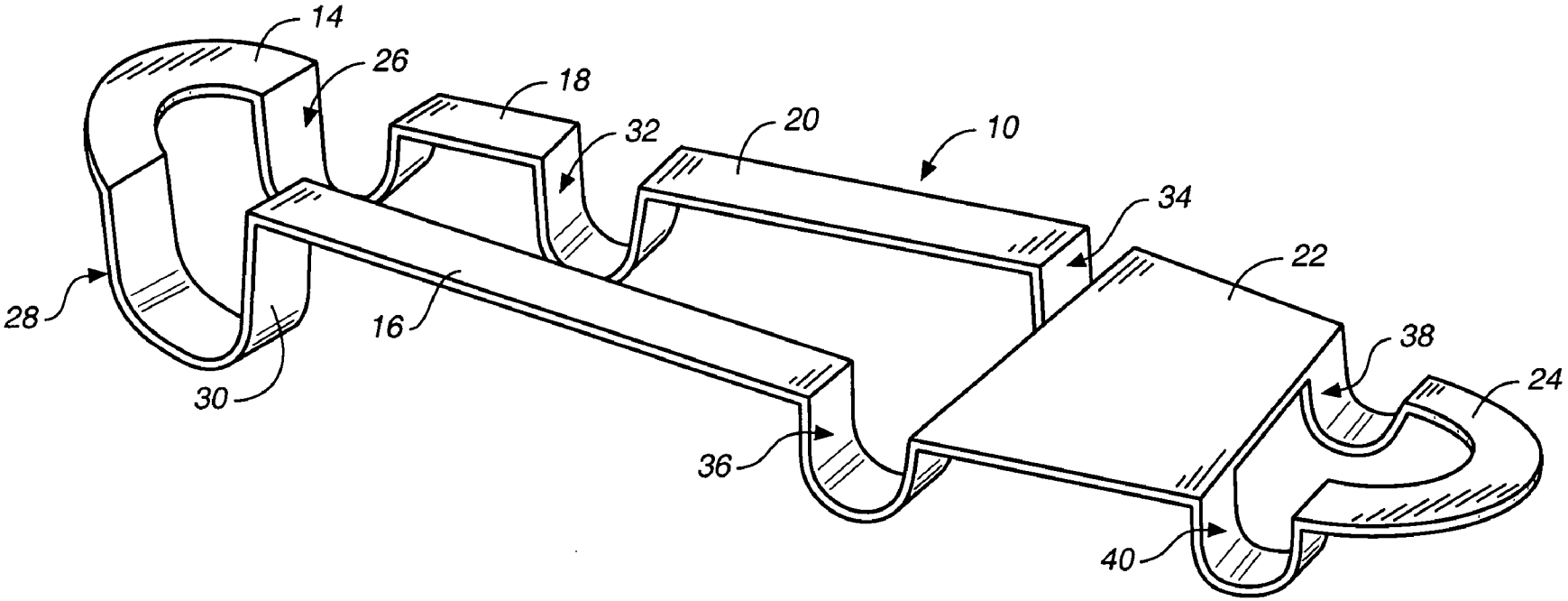
FIG. 1 is a perspective view of a shoe frame which forms a component of an athletic shoe in accordance with one embodiment of the invention.
Figure 2:
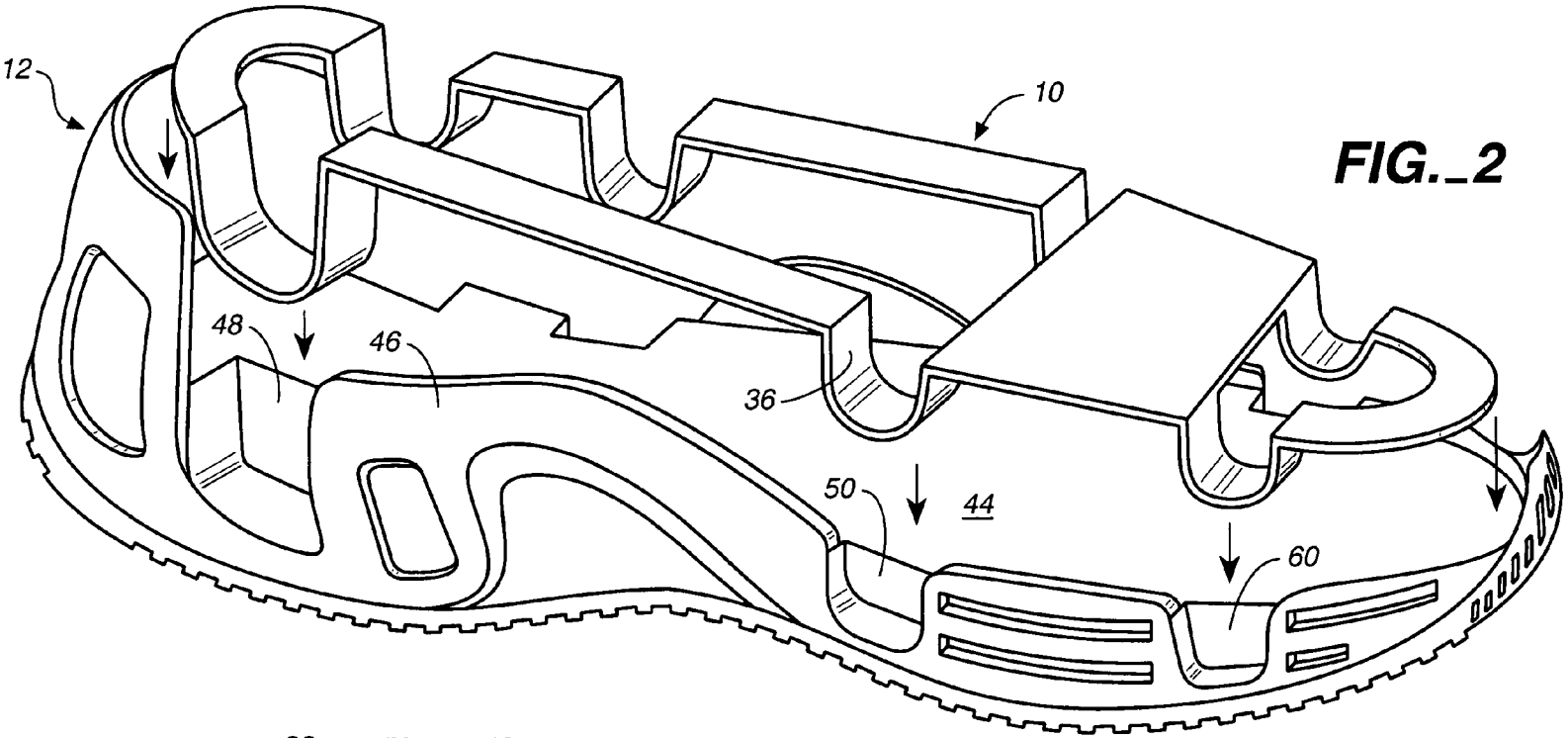
FIG. 2 is a perspective view of the shoe frame of FIG. 1 shown in one step of the method of assembly with a combination upper and midsole subassembly of the athletic shoe.

In the drawings FIGS. 1 and 2 illustrates generally at 10 a shoe frame which forms a part of the shoe stabilizing structure in accordance with one preferred embodiment of the invention. FIG. 2 shows the shoe frame of FIG. 1 in one step of the shoe manufacturing method in which the frame is positioned above and just prior to being assembled with a combination upper and midsole subassembly 12.

Figure 3:
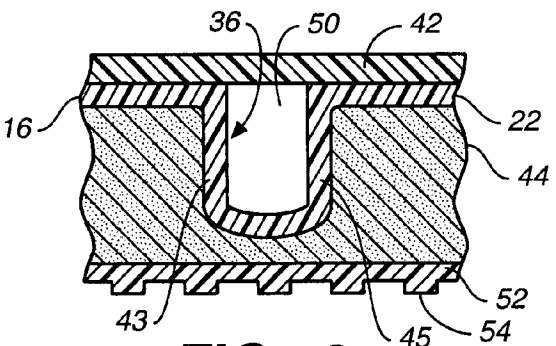
FIG. 3 is a fragmentary cross-section view to an enlarge scale showing the sandwich construction of one depression of the shoe frame fitted into a corresponding seat of the midsole.

Shoe frame 10 is formed by a suitable molding process from a thin plate of nylon, graphite or high density compression foam material. The frame is comprised of heel portion 14, side rails 16, 18 and 20, forefoot portion 22, and toe portion 24. These heel, rail, forefoot and toe portions are horizontally flat for sandwich fitment between the combination upper and midsole subassembly 12 and an insole 42 (FIG. 3). A plurality, shown as seven, of U-shaped, downwardly convex arch-shaped stabilizer elements 26–40 are formed along both sides of the frame. The elements comprise an arch having opposite sides 43, 45.

Combination upper and midsole subassembly 12 of FIG. 2 is comprised of a midsole 44 on which the walls of an upper 46 are carried. The upper can be formed integral with the midsole, or it can be a separate part that is secured to the midsole as by an adhesive or suitable bonding process. The perimeter of the midsole is formed with a plurality of upwardly concave seats 48–50.

The seats 48–50 are sized and shaped commensurate with the stabilizer elements, and are also positioned on the midsole so as to closely fit into respective ones of the stabilizer elements as the frame is dropped down onto the midsole as one step in the method of assembly. In the next step, insole 42 is fitted down onto the top of the frame. Then an outsole 52 is fitted across the bottom of the midsole. The bottom surface of the outsole can be formed with traction elements, such as the illustrated waffle shaped lugs, blades or cleats 54.

FIG. 3 shows the fitment of stabilizer element 36 into midsole seat 50. The other load stabilizing elements and midsole seats fit together in a similar fashion. When assembled together, the load stabilizing elements are tightly captured between the insole and seats.

In this embodiment the stabilizer elements are made of the nylon, graphite or high density compression foam material of which frame 10 is formed. This material provides the stabilizer elements with an elasticity which is sufficient to enable flexing of opposite arch sides 43, 45 in an amount which absorbs a portion of the energy of the load forces when the shoe is weighted. Then when the load forces decrease the elasticity further enables the arch sides to flex back and release the stored energy back into the shoe.

In use of the embodiment of FIG. 1, when the user's shod foot strikes a running surface, the load on the shoe results in upward forces on the outsole and midsole which are carried up into the stabilizing elements, stabilizing frame, insole and user's foot. The load stabilizing elements act in the manner of anchors in the material of the midsole such that the frame 10, insole and user's foot are stabilized against significant displacement. Further, when loaded the arch portions of the stabilizing elements gradually elastically flex and absorb some of energy of the load forces. Then as the load forces on the shoe decrease and the forefoot push off phase begins, the stabilizing elements flex back to their original shapes to gradually release the stored energy back into the shoe for push off. The foregoing action controls pronation (rotation toward the medial side of the foot) by minimizing distortion of the midsole as the shoe is weighted during the gait cycle.

Figure 4:
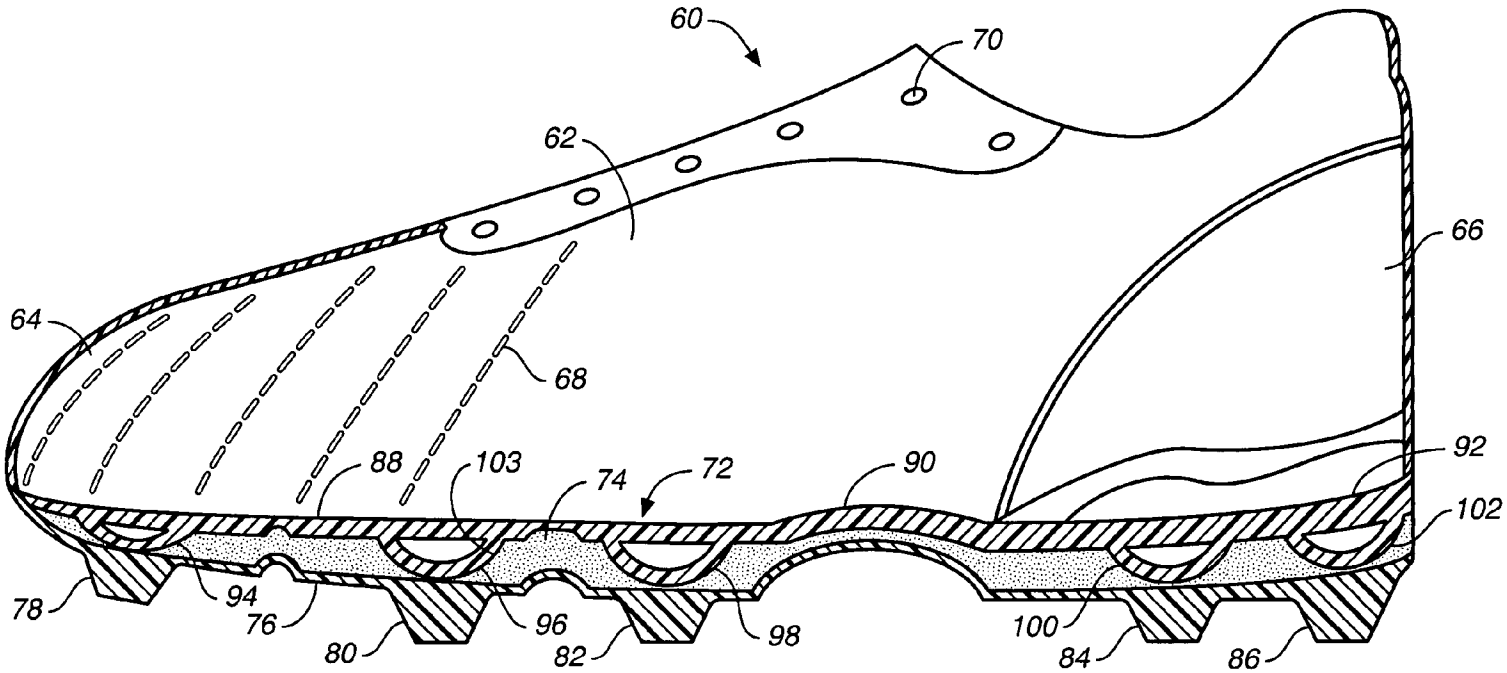
FIG. 4 is a longitudinal section view of the medial side of an athletic shoe in accordance another embodiment of the invention which is shod for wearing the right foot of a user

FIG. 4 illustrates in longitudinal section at 60 a shoe in accordance with another preferred embodiment of the invention. The figure shows the medial side of shoe 60 which is shod for wearing on the right foot of a user.

Shoe frame 60 is comprised of an upper 62 which has a toe portion 64 and heel portion 66. As desired decorative elements 68, such as stitching, may be incorporated into the upper. Openings 70 for shoe laces are formed around the foot opening in the upper.

A shoe stabilizing structure is provided comprising a shoe stabilizer frame 72 which is fitted on top of a midsole 74 which in turn is fitted on top of a cleated outsole 76. As desired an insole, not shown, could be fitted on the top of the stabilizer frame. A plurality of lugs, blades or cleats 78–86 are carried below the outsole. The cleats are positioned in a spaced-apart relationship which is desired for the type of sport for which the shoes are to be used. The cleats could be molded integral with the outsole as shown, or could be separate elements secured to the outsole by suitable means such as screw attachment, adhesive or the like.

Shoe stabilizer frame 72 is formed with a forefoot portion 88 having a generally horizontally flat surface, an arch portion 90 having an upwardly convex shape, and a heel portion 92. The frame is formed with a plurality of downwardly convex arch-shaped stabilizer elements 94–102. A plurality of upwardly concave seats 103 are formed in the midsole for seating respective ones of the stabilizer elements. The stabilizer elements are positioned above and in contact with, but not connected to, the portions of outsole 76 which are above respective ones of the cleats. This enables the stabilizer frame to not be directly connected with and free to move independent of the outsole.

Figure 5:
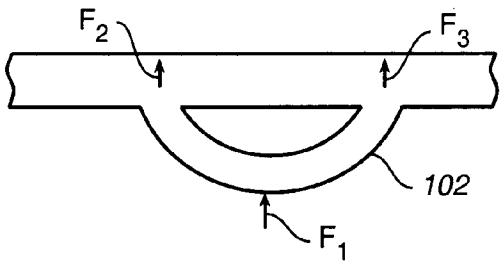
FIG. 5 is a force-load schematic diagram for a typical one of the load stabilizing elements which are components of the shoe of FIG. 4.

In use with shoe 60 is shod on the user's foot, beginning with the heel-strike phase of the gait cycle the downward force from the user's weight causes reaction forces on the heel of the shoe acting from heel cleats 84 and 86 upwardly against the rounded downwardly facing apexes of respective stabilizer elements 100 and 102. This reaction force is represented in the force-load schematic diagram for the typical stabilizer element 102 (FIG. 5) by the force vector $F_1$. This force is divided substantially in half by the arch configuration of the stabilizer element into force vectors $F_2$ and $F_3$ which react upwardly through frame 72. As the user's foot and shoe continued through the weight-loading and push-off cycles, the other stabilizer elements act in a similar manner so that the point loading forces from the array of cleats are dispersed and diminished across the sole of the shoe. This minimizes the adverse effects of the point loading forces.

Throughout the heel strike, loading, and forefoot push-off cycles the stabilizer elements flex somewhat as they elastically absorb part of the load forces. The combination of stabilizer element flexure and point load dispersion by the stabilizer elements located on the medial side helps control (i.e. minimize) the undesirable pronation of a typical user's foot following heel strike. Also, in the case of the relatively small number of people whose feet supinate following heel strike, the invention's stabilizer elements located on the medial side will act in a similar manner and help in controlling undesirable supination.

Figure 6:
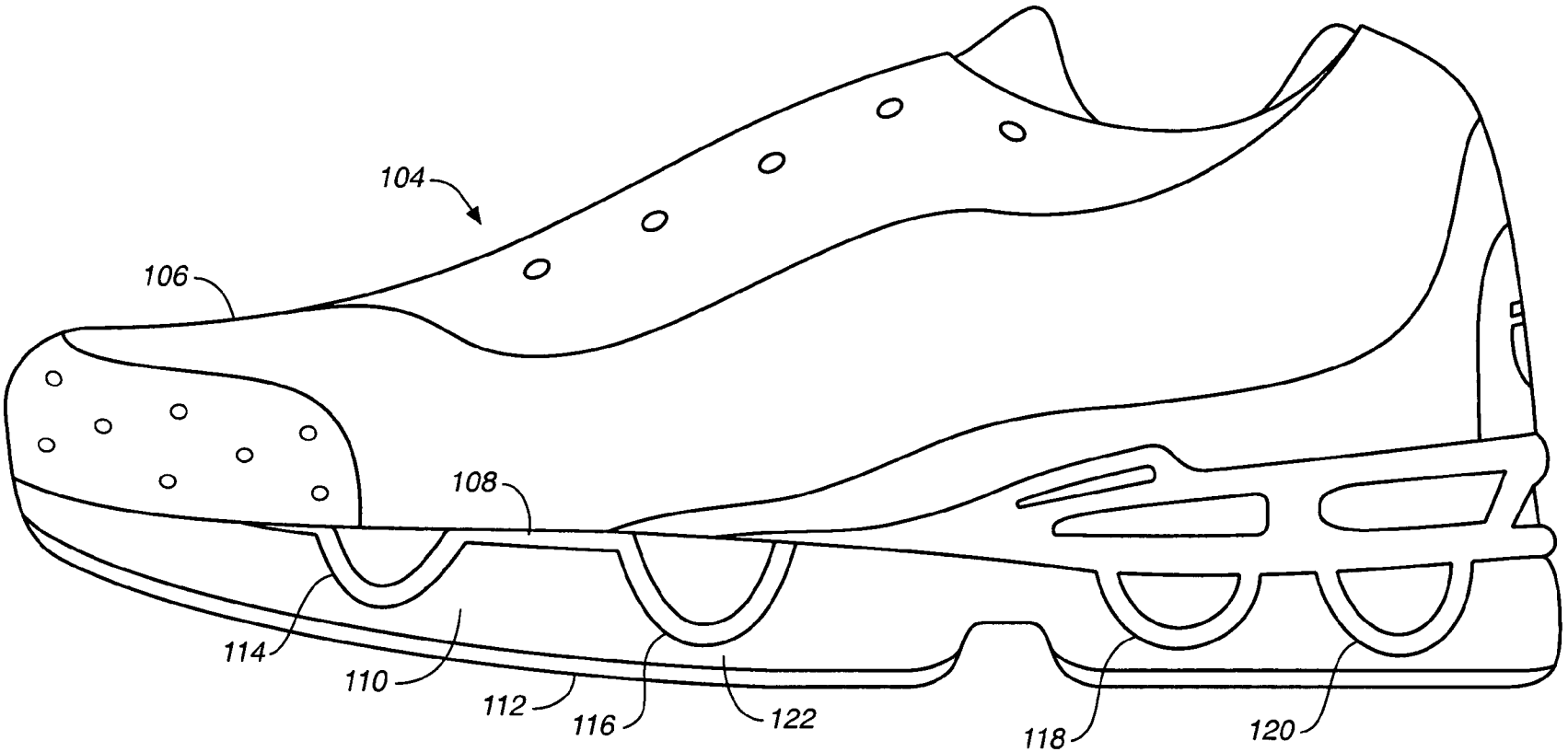
FIG. 6 is a side elevation view of the medial side of a shoe in accordance with another embodiment which is shod for wearing for the right foot of a user.
Figure 7:
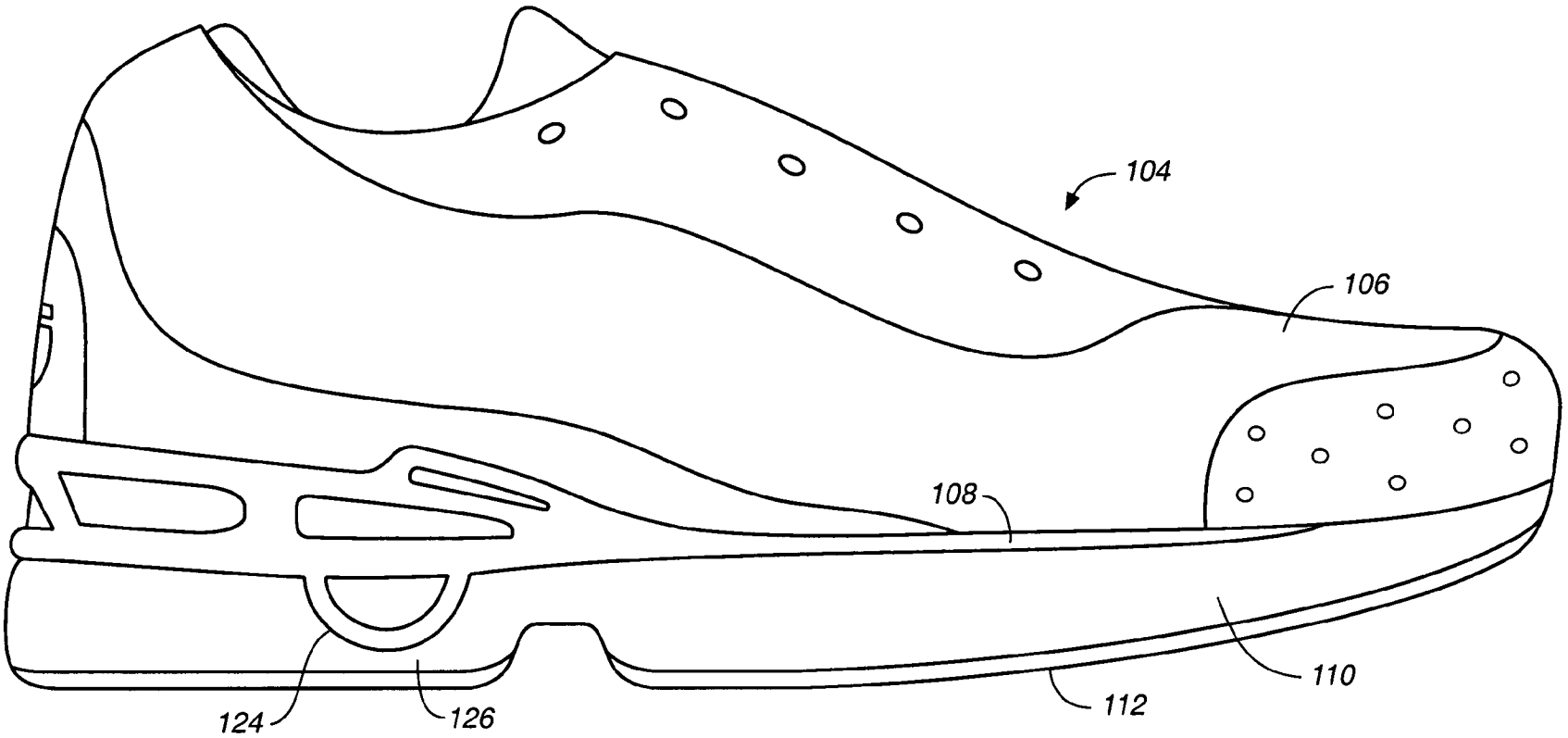
FIG. 7 is a side elevation view of the lateral side of the shoe of FIG. 6.

FIGS. 6 and 7 illustrate another embodiment providing a stabilized athletic shoe 104, which is shown for wearing on the right foot of a user. The shoe comprises an upper 106, stabilizer frame 108, midsole 110 and an uncleated outsole 112. The stabilizer frame is formed with a plurality, shown as four, of stabilizer elements 114–120. These elements have downwardly convex arch-shaped configurations as described for the embodiment of FIG. 4. Upwardly concave seats are formed in the midsole for seating respective ones of the stabilizer elements.

In the embodiment of FIGS. 6 and 7 the apexes of the stabilizer elements are spaced above and separated by a gap 122 from the outsole. The gap is occupied by midsole material, which provides a degree of cushioning when the shoe is loaded. On the medial side of the shoe as shown in FIG. 6, throughout the heel strike, loading and forefoot push-off phases the four stabilizer elements produce the flexure and load dispersion action as described for the embodiment of FIG. 4 to control undesirable pronation.

The lateral side of shoe 104 is shown in FIG. 7. On this side a single downwardly convex arch-shaped stabilizer element 124 is carried by stabilizer frame 108. A gap 126 between element 24 and frame 108 is occupied by midsole material. When a user whose foot supinates following heel strike is shod with this shoe, stabilizer element 124 produces the flexure and load dispersion action described above to help control undesirable supination

The invention claimed is:

1. An athletic shoe for stabilizing shoe movement following the heel strike phase of the gait cycle of a user shod with the shoe, the shoe comprising the combination of an upper, a midsole, an outsole, and a stabilizing frame between the upper and midsole, the stabilizing frame comprising at least first and second spaced-apart horizontally flat side rails which contact the upper, the frame having at least one stabilizer element in the shape of downwardly convex arch having an apex at the lower end of the element, the arch having sides which are joined with respective first and second side rails, the midsole comprises an upwardly concave seat which is fitted about the stabilizer element, and the stabilizer element being formed of a material which has an elasticity which is sufficient to enable the sides of the arch to flex in an amount which absorbs a portion of the energy of the load forces when the shoe is weighted by which the sides transfer the load forces through the side rails to the upper.

2. An athletic shoe as in claim 1 in which the shoe has an insole, and the frame is sandwiched between the insole and the concave seat.

3. A stabilizing structure as in claim 1 in which the frame and the concave seat are in close-fitting relationship sufficient to resist distortion of the midsole as the shoe is weighted during the gait cycle.

4. An athletic shoe as in claim 1 in which the shoe has a medial side, the stabilizing frame comprises a plurality of the stabilizer elements on the medial side of the shoe, and the midsole comprises a plurality of the seats with each seat being sized and shaped for fitment with a respective one of the stabilizer elements whereby the movement of the shoe being stabilized is pronation.

5. An athletic shoe as in claim 1 in which the shoe has a lateral side, the stabilizer element is on the lateral side of the shoe, and the midsole seat is on the lateral side fitted with the stabilizer element for stabilizing supination movement of the shoe.

6. An athletic shoe as in claim 1 in which the apex of the convex arch is in contact with but free to independently move with respect to the outsole.

7. An athletic shoe as in claim 1 in which the apex of the convex arch is spaced above the outsole.

8. An athletic shoe as in claim 1 in which the shoe comprises a cleat, and the stabilizer element is positioned above the cleat for dispersing point loading forces from the cleat following heel contact.

* * * * *